US006048252A

United States Patent [19]

Sebring

[11] Patent Number: 6,048,252

[45] Date of Patent: Apr. 11, 2000

[54] CAMISOLE FOR MASTECTOMY PATIENTS

[75] Inventor: Corene M. Sebring, Ortonville, Mich.

[73] Assignee: Gentle Touch Medical Products, Inc., Ortonville, Mich.

[21] Appl. No.: 09/119,034

[22] Filed: Jul. 20, 1998

[51] Int. Cl.[7] ..... A41C 3/00

[52] U.S. Cl. ..... 450/1; 450/23; 450/32; 450/79

[58] Field of Search ..... 450/1, 23, 31, 450/32, 57, 60, 79, 80, 82, 83, 85, 89; 2/69, 114, 102, 104, 105, 106, 115, 94; 602/1, 19, 41, 60, 61; 623/7, 8

[56] References Cited

U.S. PATENT DOCUMENTS

| | | | |
|---|---|---|---|
| 2,070,369 | 2/1937 | Miller . | |
| 2,258,209 | 10/1941 | Jorio . | |
| 2,661,470 | 12/1953 | Day . | |
| 2,717,602 | 9/1955 | Radler . | |
| 3,077,197 | 2/1963 | Garfinkel . | |
| 3,099,839 | 8/1963 | Kester . | |
| 3,348,241 | 10/1967 | Dodds . | |
| 3,498,297 | 3/1970 | Lord . | |
| 3,516,414 | 6/1970 | Greenough . | |
| 4,024,876 | 5/1977 | Penrock . | |
| 4,071,914 | 2/1978 | Silverman . | |
| 4,815,977 | 3/1989 | Peters . | |
| 5,002,270 | 3/1991 | Shine | 2/102 X |
| 5,037,348 | 8/1991 | Farino | 450/1 |
| 5,060,648 | 10/1991 | Zarkesh | 450/1 X |
| 5,098,331 | 3/1992 | Corrado | 450/58 |
| 5,152,741 | 10/1992 | Farnio | 602/19 X |
| 5,257,956 | 11/1993 | Ewen | 450/1 |
| 5,325,538 | 7/1994 | Schoenweiss | 2/102 X |
| 5,331,683 | 7/1994 | Stone et al. | 2/102 X |
| 5,427,563 | 6/1995 | Manning | 450/79 |
| 5,527,270 | 6/1996 | Chase et al. | 602/61 |

*Primary Examiner*—Gloria M. Hale
*Attorney, Agent, or Firm*—Reese Taylor

[57] ABSTRACT

A camisole-like garment for use by medical patients includes front and rear segments with the front segment divided into two panels which may be selectively, temporarily closed. The garment includes a yoke-like neck area and arm-receiving openings. Additional side openings are provided adjacent the line of joinder of the front and rear segments to provide for access for drainage tubes or the like and at least one pocket is formed on the outer surface of at least one of the front panels, also for the receipt of a drainage bulb associated with the drainage tube. Prosthesis-receiving pockets may also be provided on the inner surfaces of the front panels.

9 Claims, 3 Drawing Sheets

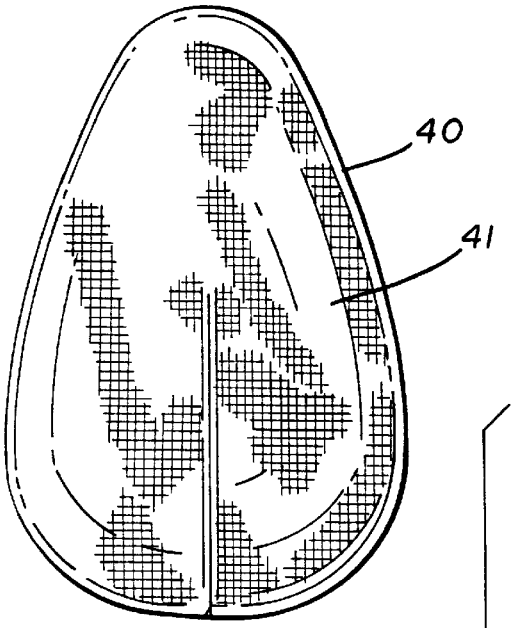
FIG. 6
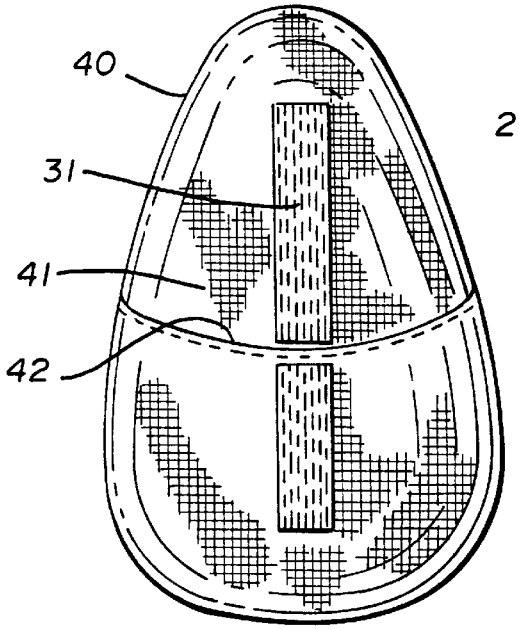
FIG. 7
FIG. 5
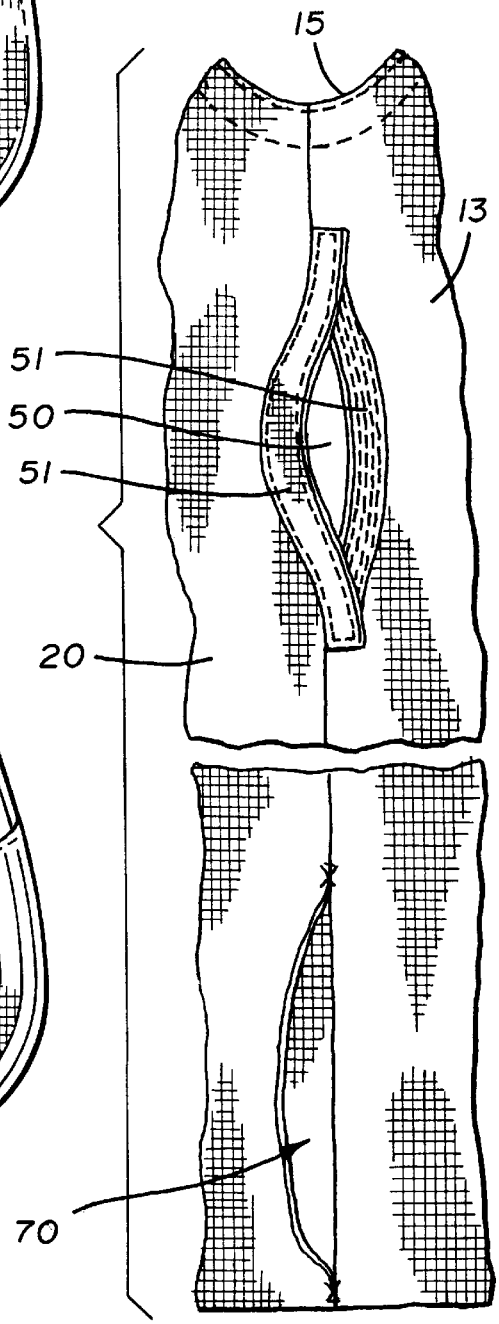

CAMISOLE FOR MASTECTOMY PATIENTS

RELATED PATENT APPLICATIONS

None.

FIELD OF THE INVENTION

This invention relates in general to articles of apparel and relates in particular to a camisole style garment intended for use by mastectomy patients.

BACKGROUND OF THE INVENTION

It is known that, during recovery, and before any permanent corrective surgery, such as implants, takes place, mastectomy patients have a psychological need for at least a temporary replacement of the breast or breasts. To that end, artificial breasts or prostheses have been provided and used in the past and various garments of wearing apparel have been provided to accommodate the wearing of these items. These garments are generally provided with pockets of some sort to receive the artificial breast or breasts so that the wearer, when wearing the garment, will appear to the casual observer to be unaffected by the surgical process. Such garments are important to the mental well being of the patient after undergoing such a traumatic operation.

One such garment commonly used for this purpose is a camisole. In that regard, these garments are often fabricated to resemble nightgowns or similar wearing apparel and the present practice is to supply the patient with these garments almost immediately following the surgery so that, at least outwardly, the patient will almost immediately present an unaltered bodily appearance.

Difficulties are encountered with the use of such garments, however, due to the usual structure of the same. That is, camisoles are generally garments which are designed to be slipped over the head of the wearer. In order to don such a garment, it is necessary to elevate the arms. However due to the nature of the mastectomy surgery, this can only be accomplished, if at all, with considerable discomfort to the patient, particularly closely following the surgery.

Furthermore, most of the camisole-like garments of this general type which are known to Applicant are designed with the artificial breast or prosthesis-receiving pockets on the outer surface of the garment because the garment itself is intended to be worn as an undergarment. It is, however, believed that camisoles, particularly when designed to resemble nightclothes, could themselves comprise the outer garment, whereby providing the pockets on the outer surface would essentially defeat the purpose of the garment itself in terms of enabling the patient to present a more natural appearance.

Attempts have been made to overcome both of the difficulties with the present garments outlined above. A camisole of the general type being discussed herein has been provided with a front opening secured by a series of Velcro® fastening elements. This enables the wearer to put the garment on without having to raise the arms, thereby minimizing the patient's discomfort. Furthermore, garments of this type have been designed and offered for sale wherein the pockets for receiving the artificial breasts or prostheses are disposed on the inner surface or the surface closest to the body of the wearer, thereby minimizing the artificiality of their appearance.

It is believed, however, that still further difficulties are presented in that it is common following surgery of this type to insert tubes into the chest area of the patient for drainage or other purposes. Drainage bulbs for receipt of fluids are attached to these tubes. In order to do so with the existing garments known to Applicant, the tubes would have to pass out through the neck opening, the arm openings or the bottom edge of the garment, thereby severely reducing the beneficial aesthetic benefits initially attained from wearing the garment.

Therefore, it is believed desirable to produce an improved camisole-type garment for use by mastectomy patients in which the breast-receiving pockets are received on the inner surface of the camisole and the camisole is provided with a front opening to facilitate donning the garment and further by providing openings in the sides of the camisole so that any tubes connected to the chest area of the patient can be passed unobtrusively to the rear of the patient and will not be normally observed by someone viewing the patient. Alternatively, pockets may be provided on the garment for receipt of the drainage bulbs.

SUMMARY OF THE INVENTION

It is has been found that an improved garment of the type generally described above can be provided by providing a generally conventionally designed camisole garment, but one having opposed side openings which are capable of being temporarily closed off or opened up as desired to enable the passage of drainage tubes or other such medical apparatus to pass from the chest area of the patient to the rear of the patient.

In furtherance of this principal object, it has been found to be advantageous to locate such openings in the sides of the garment below the arm openings.

Still further, it has been found advantageous to provide means for selectively opening and closing such openings by use of Velcro® or some similar releasable securing means.

Still further, it has been found that the drainage bulbs can be unobtrusively accommodated on the front of the garment by providing pockets so that the bulbs can be received therein during use and readily removed for inspection and emptying.

Accordingly, production of an improved camisole-type garment of the character above described becomes the principal object of this invention with other objects thereof becoming more apparent upon a reading of the following brief specification considered and interpreted in view of the accompanying drawings.

BRIEF DESCRIPTION OF THE DRAWINGS

FIG. 5 is a partial elevational view, in section, taken along the line 5—5 of FIG. 1;

FIG. 6 is a front elevational view of the improved prosthesis; and

FIG. 7 is a rear elevational view of the improved prosthesis.

BRIEF DESCRIPTION OF THE PREFERRED EMBODIMENTS

Figure 1:
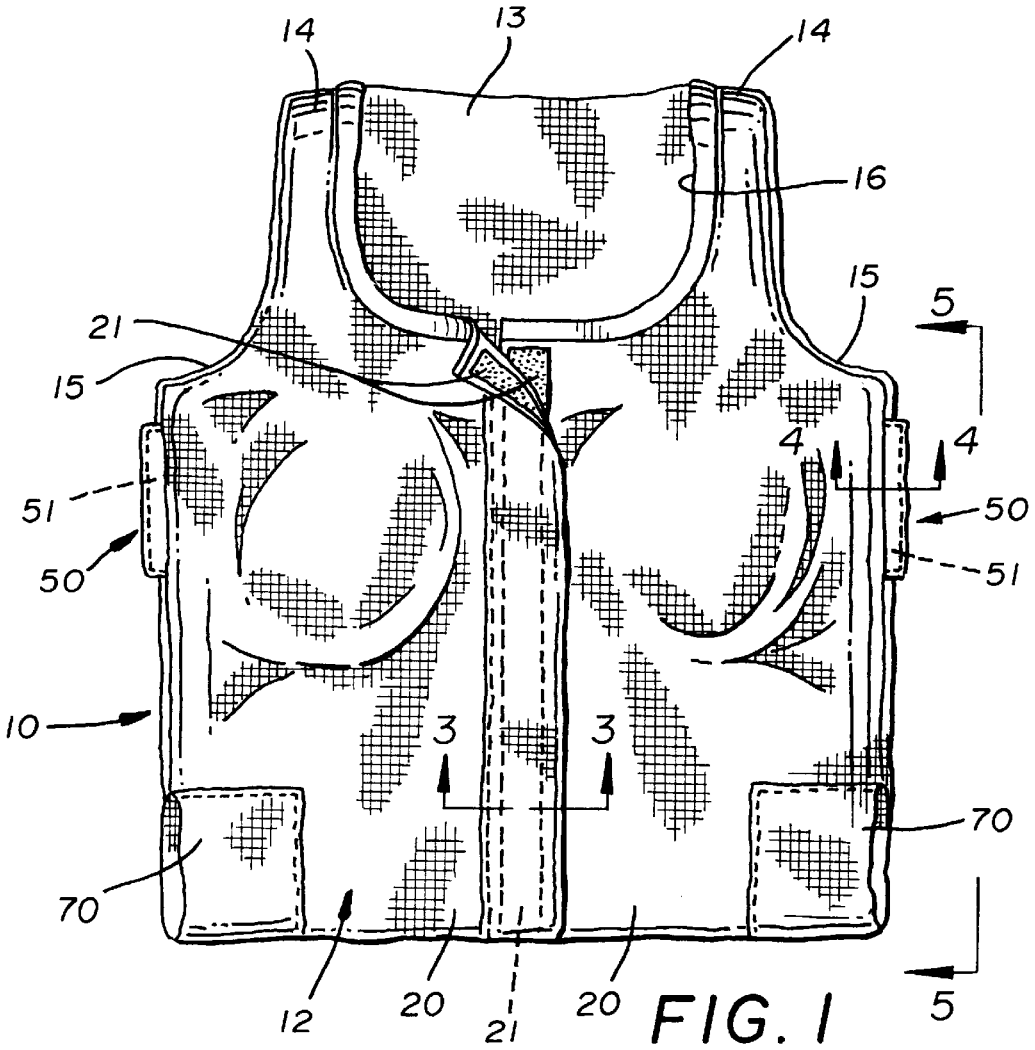
FIG. 1 is a front elevational view of the improved garment.
Figure 3:
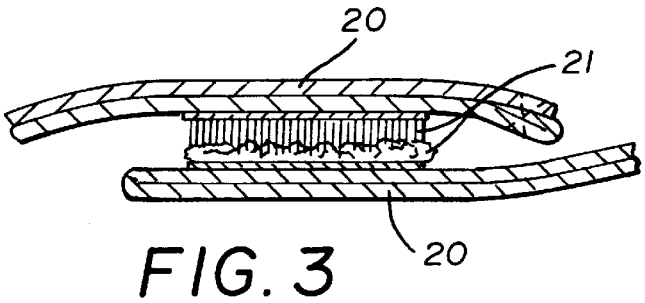
FIG. 3 is a sectional view taken along the line 3—3 of FIG. 1.
Figure 4:
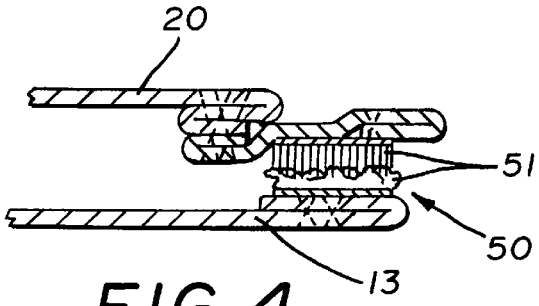
FIG. 4 is a sectional view taken along the line 4—4 of FIG. 1.

Referring first then to FIG. 1 of the drawings, it will be seen that the garment, generally indicated by the numeral 10, is preferably constructed of one piece of material and includes a main body portion 11 comprising integral front and rear segments 12 and 13 and a shoulder-engaging portion 14. The shoulder-engaging portion 14 is joined to the front segment 12 and the rear segment 13 so as to form arm-receiving openings 15,15 and a neck-receiving opening 16.

Figure 2:
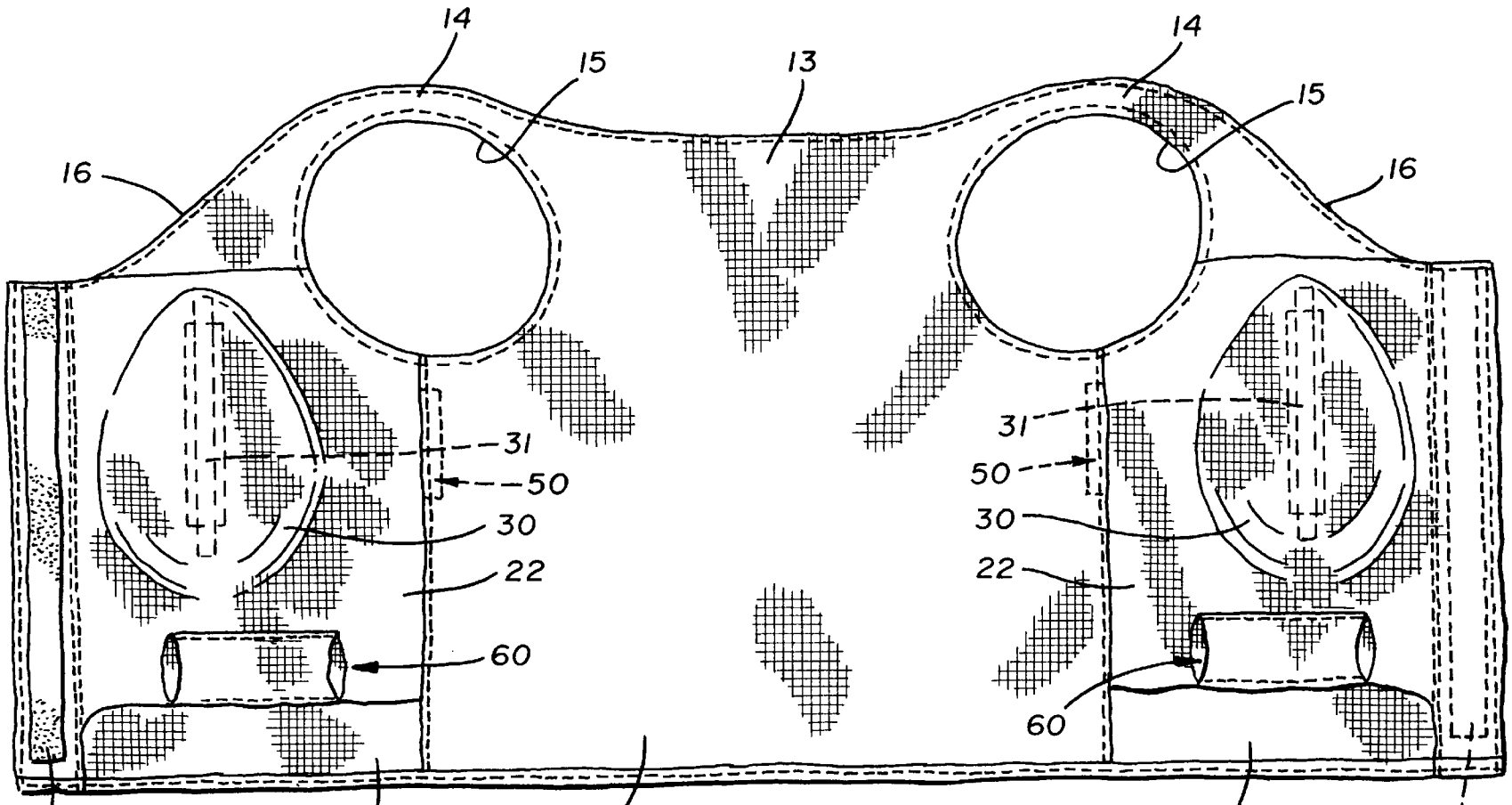
FIG. 2 is a rear elevational view of the garment in its opened condition.

The front segment 12 is divided into opposed front panels 20,20 with those segments being separated as can clearly be seen in FIGS. 1 and 2 of the drawings. These sections can be removably or releasably attached to each other by the utilization of Velcro® closure strips 21. In that regard, FIG. 1 illustrates the front sections 20,20 in the closed position, while FIG. 2 illustrates the same in the opened position. In the form of the invention illustrated, a single elongate strip of Velcro® is employed, although other types of easily releasable closure members could also be used.

In this fashion, the garment can be provided to the patient in the FIG. 2 condition, making it quite easy for the patient to don the garment following which the segments 20,20 can be brought together and secured to the position of FIG. 1.

Turning then to FIGS. 1, 2, 6 and 7 of the drawings, it will be seen that the opposed front panels 20,20 have an outer and inner surface with FIG. 2 illustrating the inner surface thereof. Each front panel 20 then has a prosthesis-receiving pocket defined by an overlapped layer of material 22 which is disposed in substantial parallelism with the inner surface of the panel 20 and stitched or otherwise secured thereto. This layer of material 22 defines a pocket or pockets between layer 22 and the rear surface of panels 20,20. The pockets are generally indicated by the numerals 30,30. Attachment means 31,31 are provided on the surface of layer 22 facing the panel 20 of each pocket and these means consist primarily of a Velcro® strip extending longitudinally of the pocket 30 and parallel to the longitudinal edges of the material which forms the pocket along the inner surface of the front panel 20. A mating strip is also carried by the prosthesis itself. Again, Velcro® is illustrated as the fastening means, but other easily releasable means could also be employed.

The prosthesis 40 is illustrated in FIGS. 6 and 7 of the drawings and is shaped as nearly as possible to the normal configuration of the breast and includes a fabric cover or envelope 41 within which suitable material, such as foam, may be inserted to actually form the mass of the prosthesis which is, as illustrated, a generally teardrop shape viewed in elevation. The cover 41 is split as at 42 to facilitate insertion and removal of the prosthesis.

A Velcro® strip 42 is received on the rear surface of each prosthesis 40 so that, when inserted in the pockets 30, the prosthesis 40 can be secured to the Velcro® strip 31 of the pocket to hold it in place.

Particular attention is next called to FIGS. 1, 2 and 5 of the drawings wherein it will be seen that an opening, generally indicated by the numeral 50, is formed in the area of the juncture between the opposed segments 20,20 and the rear segment 13. This opening can be of variable sizes and is bordered by Velcro® strips 51,51. In FIG. 5, the opening is shown in the "opened" position, and in that position, it is capable of receiving tubes and drainage bulbs from the chest area of the wearer when the garment is in the condition of FIG. 1 of the drawings and when it is being worn by the wearer. In this way, it is possible to provide for use of the necessary drainage tubes and drainage bulbs by the wearer without detracting in any way from the aesthetic appearance presented by the garment when in place. Of course, if no tubes are required in a particular situation, the openings can simply be closed off so as not to detract from the aesthetic appearance of the garment.

It will be noted that, while the precise location of each opening is, to some degree, a matter of choice, it is desirable to locate the openings below the arm openings so as to not interfere with movement of the wearer's arms.

One alternative means for concealing the tubes and bulbs is known. Referring to FIGS. 1, 2 and 5 of the drawings, it will be seen that pockets 60,60 can be formed on the inside of the front panels 20,20. In this way, the drainage bulbs can be stored during use inside the camisole when it is in the condition of FIG. 1 of the drawings.

However, it has been found that these alternative means can be improved. Thus, pockets 70,70 (see FIGS. 1 and 5 of the drawings) can be provided on the other surface of front panels 20,20 for receipt of the bulbs. This location of pockets 70,70 facilitates periodic inspection by medical personnel, as well as emptying the bulbs as needed, with minimal disturbance to the patient. Thus, the bulbs are hidden from view but easily accessible.

While a full and complete description of the invention has been set forth in accordance with the dictates of the patent statutes, it should be understood that modifications can be resorted to without departing from the spirit hereof or the scope of the appended claims.

What is claimed is:

1. A garment for use with artificial breast prostheses, comprising:

a) a body having 1) front and rear body segments, adjacent each other defining a line of joinder therebetween, 2) a shoulder-engaging portion interconnecting said front and rear segments and defining, with said front and rear segments, a neck-receiving and opposed arm-receiving openings;

b) prostheses-receiving pockets disposed on said front body segment;

c) side openings disposed in said body below said arm-receiving openings adjacent the line of joinder of said front and rear body segments and proximate to said prosthesis receiving pockets; and d) means for releasably opening and closing said side openings.

2. The garment of claim 1 wherein said front segment comprises opposed front panels and means for releasably interconnecting said front panels.

3. The garment of claim 2 wherein said front panels have inner and outer surfaces; at least one pocket formed on the outer surface of at least one of said front panels.

4. The garment of claim 1 wherein said front body segment includes at least one pocket below said side openings.

5. A garment for use with artificial breast prostheses, comprising:

a) a body having 1) front and rear body segments, adjacent each other defining a line of joinder therebetween, 2) a shoulder-engaging portion interconnecting said front and rear segments and defining, with said front and rear segments, a neck-receiving and opposed arm-receiving openings;

b) prostheses-receiving pockets disposed on said front body segment;

c) means for releasably opening and closing said side openings;

d) wherein said front body segment includes at least one pocket below said side openings.

6. The garment of claim 5, wherein said side openings are disposed below said arm openings.

7. The garment of claim 5, or claim 6 further characterized by means for releasably opening and closing said side openings.

8. The garment of claim 5, wherein said front segment comprises opposed front panels and means for releasably interconnecting said front panels.

9. The garment of claim 8, wherein said front panels have inner and outer surfaces;

at least one pocket formed on the outer surface of at least one of said front panels.

* * * * *